US011731147B2

(12) United States Patent
Soulard et al.

(10) Patent No.: US 11,731,147 B2
(45) Date of Patent: Aug. 22, 2023

(54) ASSEMBLY FOR DISPENSING A FLUID PRODUCT

(71) Applicant: SHISEIDO INTERNATIONAL FRANCE, Paris (FR)

(72) Inventors: Fabrice Soulard, Fay Aux Loges (FR); Bruno Simon, Boulay-les-Barres (FR)

(73) Assignee: SHISEIDO INTERNATIONAL FRANCE, Paris (FR)

( * ) Notice: Subject to any disclaimer, the term of this patent is extended or adjusted under 35 U.S.C. 154(b) by 79 days.

(21) Appl. No.: 17/425,822

(22) PCT Filed: Jan. 27, 2020

(86) PCT No.: PCT/FR2020/050122
§ 371 (c)(1),
(2) Date: Jul. 26, 2021

(87) PCT Pub. No.: WO2020/157422
PCT Pub. Date: Aug. 6, 2020

(65) Prior Publication Data

US 2022/0161285 A1 May 26, 2022

(30) Foreign Application Priority Data

Jan. 28, 2019 (FR) ..... 1900733

(51) Int. Cl.
*B05B 11/00* (2023.01)
*B05B 11/10* (2023.01)

(52) U.S. Cl.
CPC ..... *B05B 11/0056* (2013.01); *B05B 11/0027* (2013.01); *B05B 11/0038* (2018.08); *B05B 11/1084* (2023.01)

(58) Field of Classification Search
CPC ..... B05B 11/0056; B05B 11/0027; B05B 11/0038; B05B 11/3084; B05B 11/0037; B05B 15/62; B65D 83/42; B65D 83/56; B65D 83/68
See application file for complete search history.

(56) References Cited

U.S. PATENT DOCUMENTS

| | | | |
|---|---|---|---|
| 3,330,481 | A | 7/1967 | Dearling |
| 2017/0165696 | A9 | 6/2017 | Bruder |

FOREIGN PATENT DOCUMENTS

| | | | |
|---|---|---|---|
| GB | 2463716 | A | 3/2010 |
| JP | S51-97068 | U | 8/1976 |
| KR | 20-2018-0002321 | U | 8/2018 |

(Continued)

OTHER PUBLICATIONS

International Search Report for PCT/FR2020/050122 dated Oct. 20, 2020.

(Continued)

*Primary Examiner* — Vishal Pancholi
(74) *Attorney, Agent, or Firm* — Sughrue Mion, PLLC

(57) ABSTRACT

A assembly for dispensing a fluid product having a first fluid-product dispenser with a first reservoir, a first dispensing member, such as a pump, provided with a first dispensing head and a first pusher, and a second fluid-product dispenser with a second reservoir, a second dispensing member, such as a pump, provided with a second dispensing head and a second pusher. The second dispenser is removably mounted on the first dispenser so as to prevent the actuation of one of the two dispensers.

16 Claims, 5 Drawing Sheets

(56) References Cited

FOREIGN PATENT DOCUMENTS

WO 2014/110224 A2 7/2014

OTHER PUBLICATIONS

Figure 2:
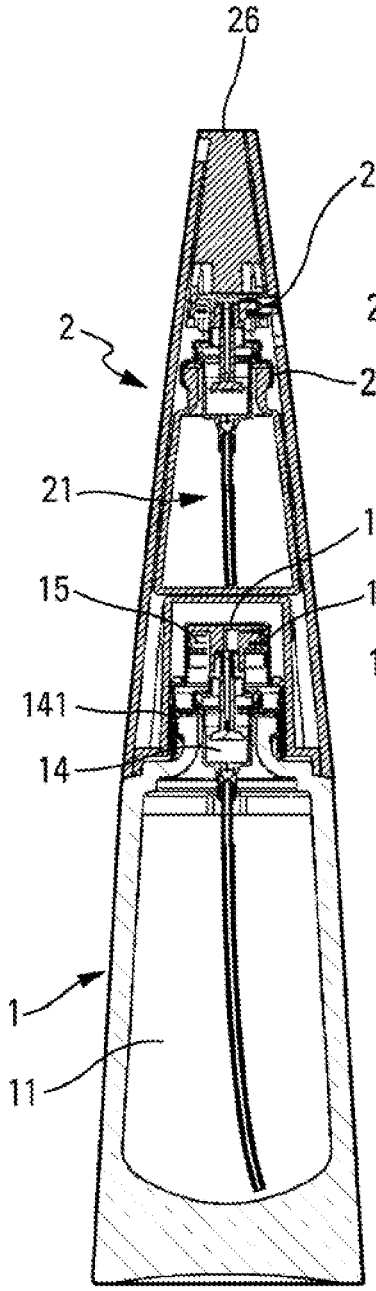

Written Opinion for PCT/FR2020/050122 dated Oct. 20, 2020.
International Preliminary Report on Patentability with translation of Written Opinion dated Jul. 27, 2021 from the International Bureau in International Application No. PCT/FR2020/050122.

ASSEMBLY FOR DISPENSING A FLUID PRODUCT

CROSS REFERENCE TO RELATED APPLICATIONS

This application is a National Stage of International Application No. PCT/FR2020/050122 filed Jan. 27, 2020, claiming priority based on France Patent Application No. 1900733 filed Jan. 28, 2019.

The present invention relates to a fluid-product dispenser assembly implementing two fluid-product dispensers, each comprising a reservoir, a dispensing member such as a pump, which is provided with a dispensing head that can integrate a pusher and a dispensing orifice. The favoured field of application of the present invention is that of perfumery, but it can also apply to fields of cosmetics.

In the prior art, dispensing assemblies incorporating two dispensers, like for example "dual" dispensers. This type of "dual dispenser" assembly generally comprises two reservoirs, two dispensing members and a common dispensing head with two distinct dispensing orifices or one common dispensing orifice. This type of dual dispenser assembly is used to mix two different fluid products, either at the level of the dispensing head or at the outlet of the dispensing orifices. Of course, the aim of these dual dispensing assemblies is to be able to actuate the two dispensers simultaneously or consecutively.

In the prior art, there is also another type of dispensing assembly comprising two dispensers. These are assemblies consisting of a source bottle with which is associated a refillable dispenser, commonly designated under the term "nomadic". The nomadic dispenser, equipped with a filling valve, may be fitted on the actuator rod of the source bottle so as to fill the reservoir of the nomadic dispenser. In other words, the nomadic dispenser is used to actuate the source dispenser.

The present invention aims to define another type of dispenser assembly, which is neither a dual assembly nor a source/nomadic assembly.

To do this, the present invention proposes a fluid-product dispenser assembly comprising a first fluid-product dispenser comprising a first reservoir, a first dispensing member, such as a pump, provided with a first dispensing head and a first pusher, and a second fluid-product dispenser comprising a second reservoir, a second dispensing member, such as a pump, provided with a second dispensing head and a second pusher, the second dispenser being mounted removably on the first dispenser so as to prevent the actuation of one of the two dispensers, characterised in that the capacity of the second reservoir of the second dispenser is much smaller than that of the first reservoir of the first dispenser, the second dispenser comprising an outer shell which is largely open at its lower end and has a notch for the passage of the second pusher, as well as a window for a dispensing orifice, the second dispenser also comprising an insert part which is engaged inside the outer shell and which forms with the shell an inner space in which the second reservoir is disposed, as well as a receiving housing in which the dispensing member of the first dispenser is received, the second dispenser being integrated with the shape of the first dispenser, and in particular with the shape of the first reservoir, such that the second dispenser can be likened to a simple protective cap which covers the upper part of the first dispenser, only the notch and the window making it possible to understand that this particular cap acts as a dispenser.

Thus, clearly dual assemblies and nomadic source assemblies are excluded. The structural link between the two dispensers is a removable connection, which is not found in dual assemblies. Even in the source/nomadic assemblies, it is not possible to speak of mounting the nomad on the source bottle, given that the only temporary point of contact is the free end of the actuator rod of the source bottle. On the other hand, the assembly of the invention performs a novel function, namely, to prevent the actuation of one dispenser by means of the other dispenser. This is clearly not the case in dual assemblies and nomadic source assemblies. The assembly of the invention however offers a coherent entity that the user can handle without risk of the two dispensers disconnecting.

The second dispenser may be held by friction or snap-fitting, or also by screwing or magnetisation on the first dispenser by masking the first dispensing head and the first pusher, thus forming a protective cap for the first dispenser. By focusing on the appearance, it is even possible for the second dispenser to visually resemble a simple protective cap: the user only later discovering that this cap also acts as an additional, nomadic or auxiliary dispenser.

According to a practical embodiment, the second dispenser further comprises an outer shell in which the second reservoir is removably mounted so as to be able to be extracted manually from the outer shell. Thus, the second reservoir may be replaced or simply filled before being put into place in the outer shell. Advantageously, the second dispenser further comprises an insert part that is received in the outer shell, the insert part forming with the shell an internal space for the second reservoir and a receiving housing for the first dispensing head. This insert part can also be used to guide the second pusher.

According to an advantageous characteristic of the invention, the insert part may be removably mounted in the outer shell, so as to be able to be extracted manually therefrom, advantageously by grasping it by the receiving housing, in order to extract the second reservoir. In other words, the second dispenser is almost entirely removable so as to be able to remove the second reservoir for its replacement or its filling. In a variant, the receiving housing may communicate directly with the internal space, so as to make it possible for the second reservoir to be withdrawn through the receiving housing of the insert part. In this case, it is not necessary to extract the insert part from the outer shell.

According to another advantageous embodiment, the second dispenser may comprise a bottom part integrating the second reservoir and a top part integrating the second dispensing member, the second reservoir comprising a threaded neck and the second dispensing member comprising a fixing ring to be screwed which is engaged with the threaded neck of the second reservoir, such that the bottom and top parts may be separated by unscrewing, so as to have access to the second reservoir in order to extract it from the bottom part.

According to another advantageous aspect of the invention, the second dispensing member may be removably mounted on the second reservoir and the first dispensing member may advantageously be removably mounted on the first reservoir, so as to fill the second reservoir with the first reservoir. The assembly of the invention is then similar to a source/nomadic assembly, with the capacity of the reservoir of the first dispenser which is advantageously much greater than that of the reservoir of the second dispenser.

According to another practical embodiment, the first dispensing member may be mounted on the first reservoir by means of a fixing ring, the second fluid-product dispenser coming into removable engagement with the fixing ring. In a variant, it is also possible to mount the second dispenser directly on the first reservoir of the first dispenser.

However, in the scope of the source/nomadic assembly, it can also be considered that the second reservoir is provided with a filling valve. Thus, it can be refilled by means of the first dispenser or another dispenser. In a variant, the second reservoir may be provided with an opening closed by a plug, advantageously formed by the insert part.

According to another particularly aesthetic embodiment, the first reservoir can form a niche, in which the second dispenser is received in a removable manner, the niche masking the second dispensing head and optionally the second pusher. Thus, the second dispenser may be entirely surrounded by the first reservoir of the first dispenser. It can be held in the niche by friction or by snap-fitting. The second pusher may be visible, but the dispensing of fluid-product will be prevented due to the closure of the dispensing orifice formed at the level of the dispensing head. By "niche", this means any recess, depression, slot, notch, housing, cavity, hole, passage, tunnel, through-passage or blind, formed by the reservoir, which is advantageously made as a single piece or in several parts made of glass, plastic material, metal, etc.

It must be noted that such a reservoir forming a niche for a second dispenser can form the subject of a protection per se, i.e. independently of the fact that the removable mounting of one dispenser prevents its actuation or the actuation of the other dispenser.

The scope of the invention resides in discreetly integrating a second dispenser with a first dispenser, which can generally retain a conventional configuration. The aim is that the second dispenser is as invisible as possible. The capacity of the second reservoir of the second dispenser is preferably much smaller than that of the first reservoir of the first dispenser. This makes it possible to produce the second dispenser with a much smaller size than that of the first dispenser. The second dispenser may be placed above the first dispenser, or, on the contrary, it may be placed below it, for example integrated into a base or a baseplate. The second dispenser can also be integrated into the reservoir of the first dispenser. Numerous variants are possible, insofar as the second dispenser is removably mounted on the first dispenser by preventing its actuation or the actuation of the other dispenser.

The invention will now be described more fully below, with reference to the accompanying drawings which show four embodiments of the invention by way of non-limiting examples.

Figure 1:
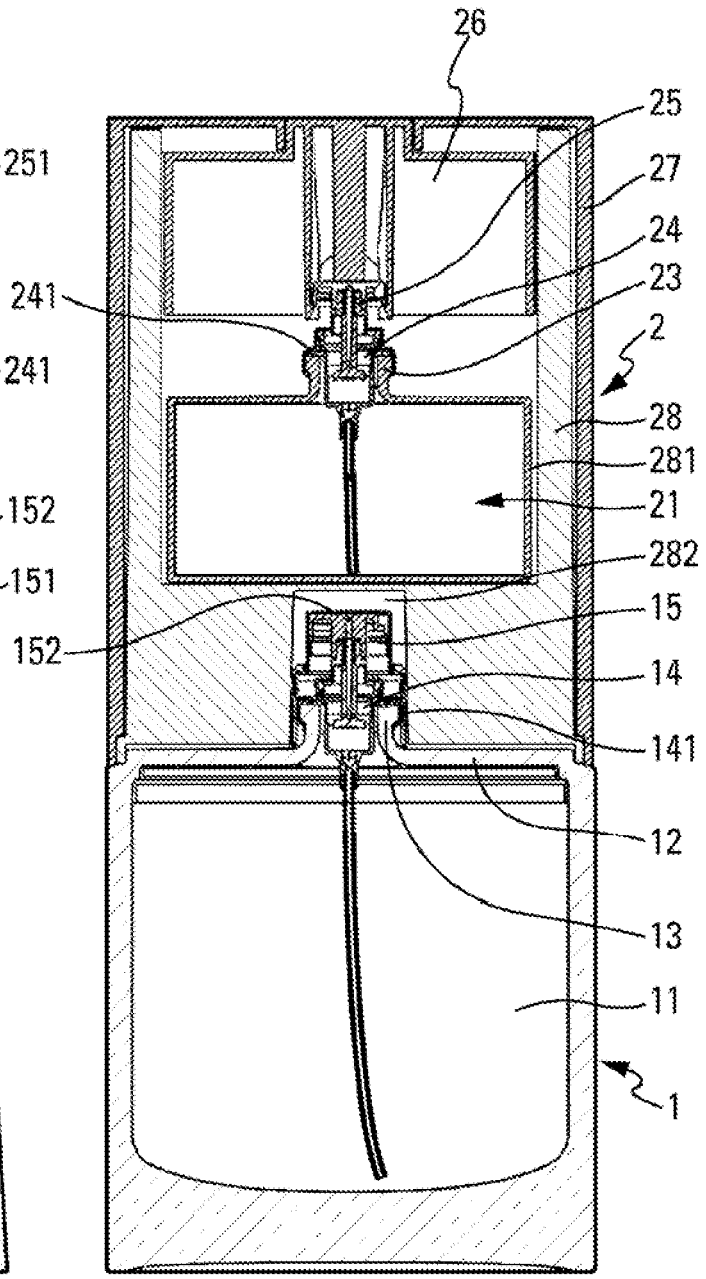
Figure 3:
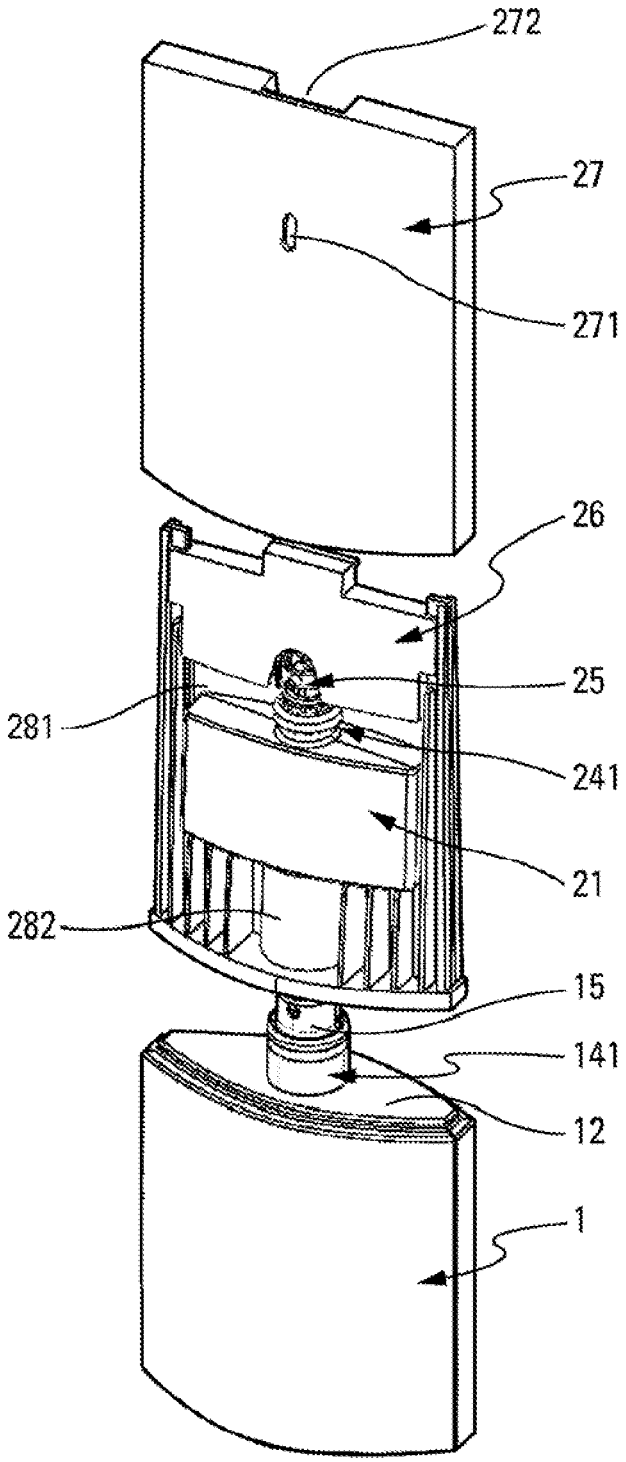
Figure 4:
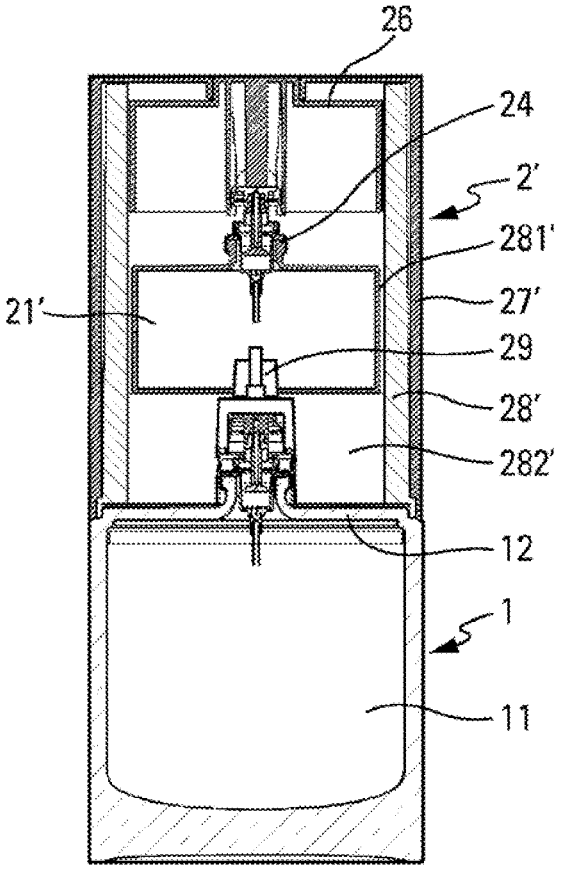
Figure 5:
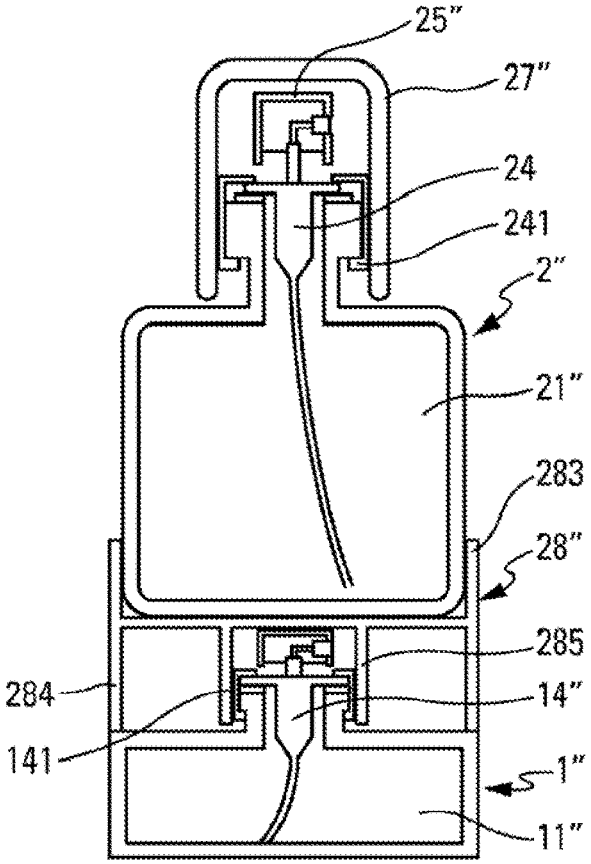
Figure 6:
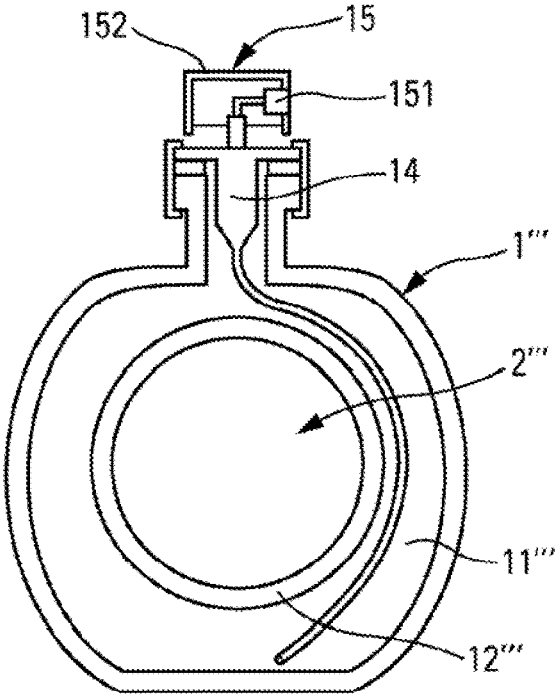
Figure 7:
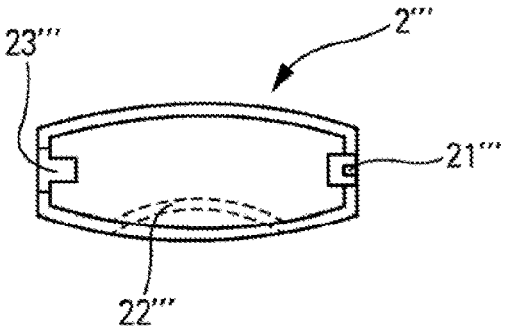
Figure 8A:
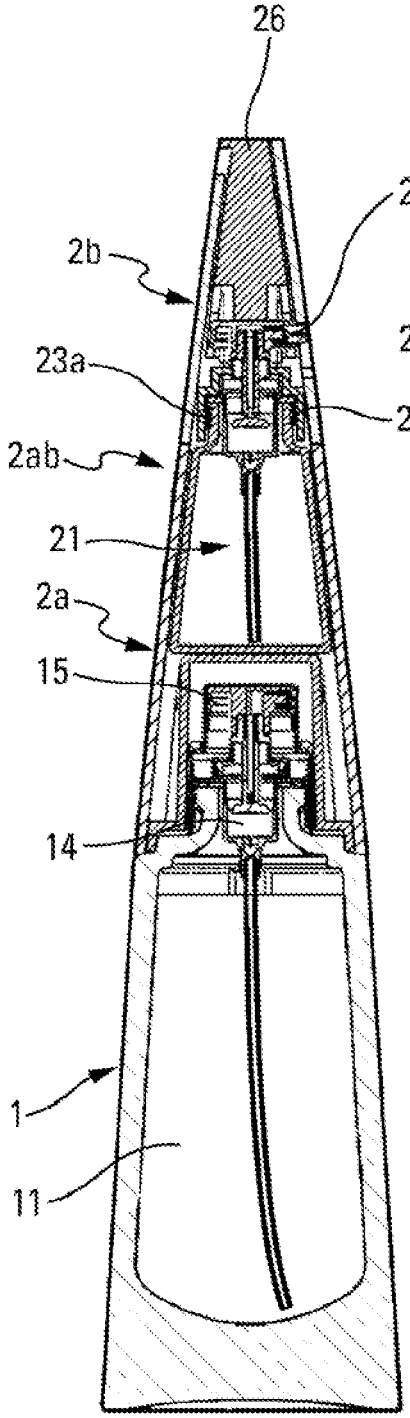
Figure 8B:
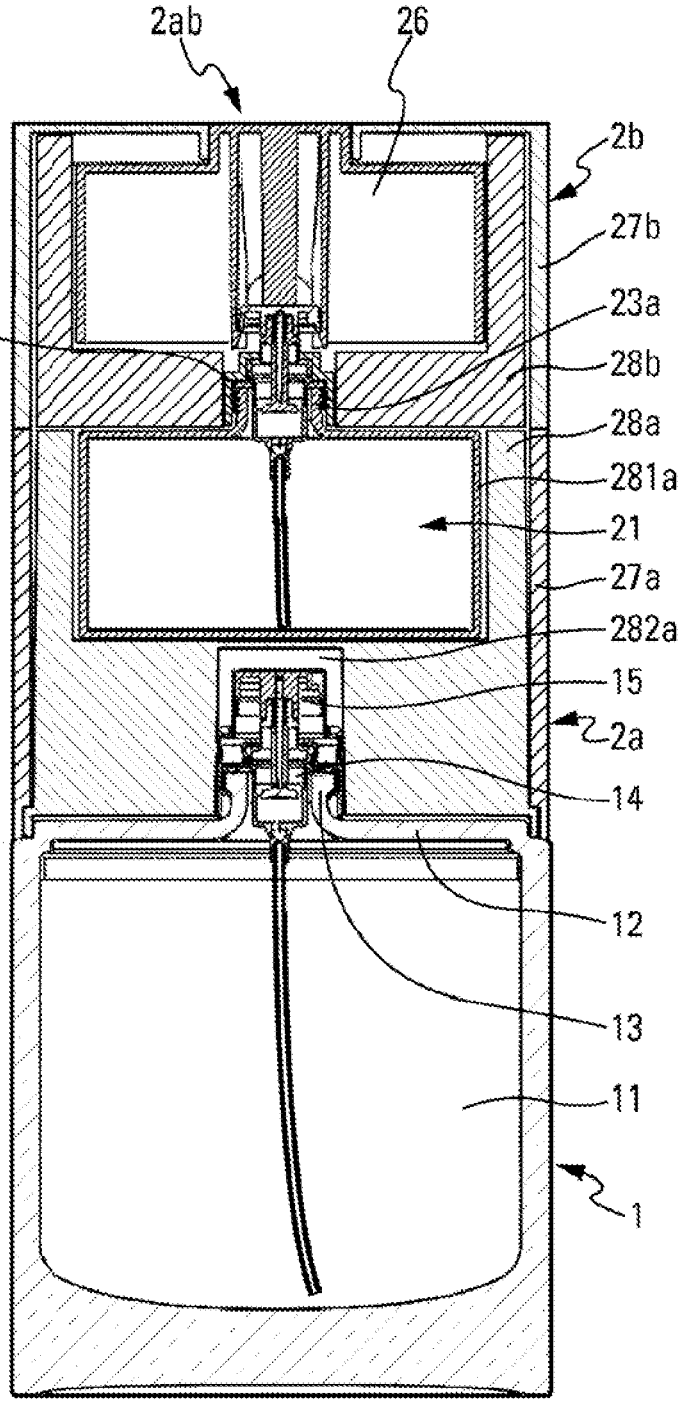
Figure 9:
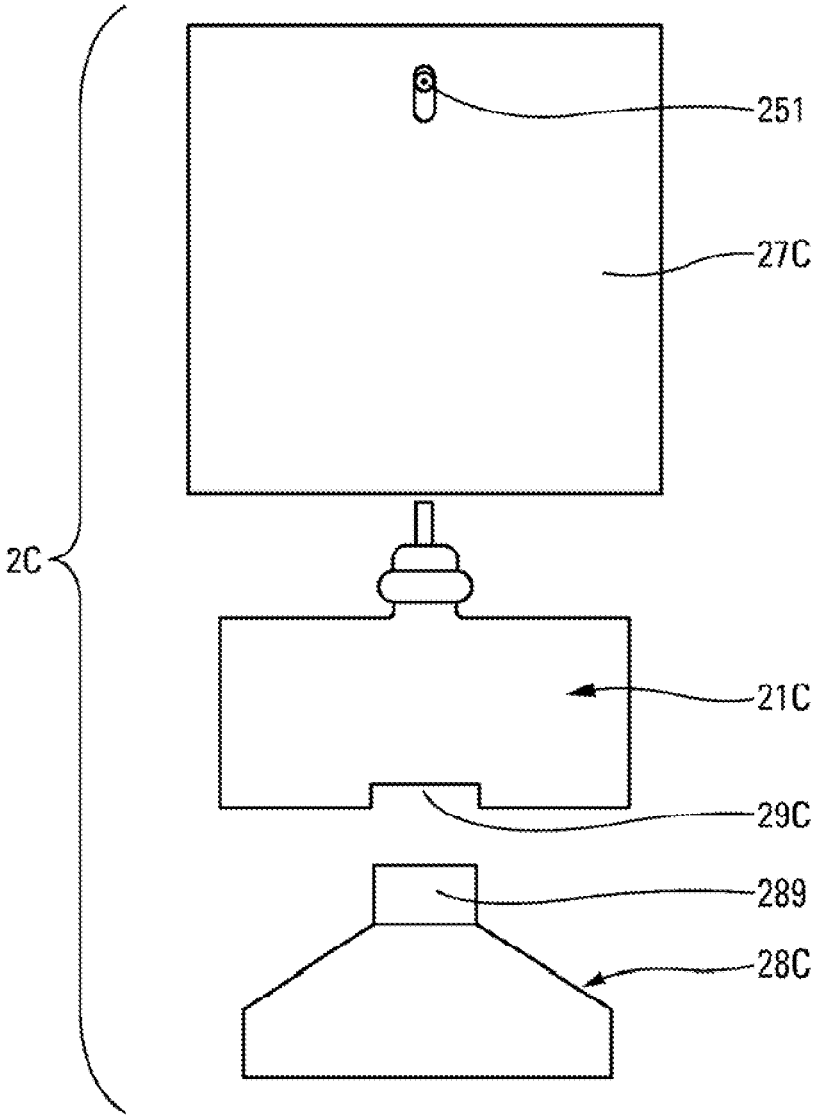

In the figures:

FIGS. 1 and 2 are vertical transverse cross-sectional views along perpendicular planes of a dispensing head according to a first embodiment of the invention, FIG. 3 is an exploded perspective view of the dispenser of FIGS. 1 and 2, FIG. 4 is a view similar to that of FIG. 1 for a second embodiment of the invention, FIG. 5 is a view similar to that of FIGS. 1 and 4 for a third embodiment, FIG. 6 is a vertical transverse cross-sectional view through a dispensing assembly according to a fourth embodiment, FIG. 7 is a transverse cross-sectional view through the second dispenser of the dispensing assembly of FIG. 6, FIGS. 8*a* and 8*b* are views similar to FIGS. 1 and 2 for a variant embodiment, and FIG. 9 is a schematic view of a second dispenser according to another embodiment.

Reference is made initially to FIGS. 1 to 3 in order to describe in detail the first embodiment of a dispenser assembly according to the invention. This comprises a first fluid-product dispenser 1 and a second fluid-product dispenser 2. According to the invention, the second dispenser 2 is removably mounted on the first dispenser 1. In other words, the second dispenser 2 can be removed from the first dispenser 1.

The first dispenser 1 has an absolutely conventional configuration in the field of perfumery or of cosmetics. It comprises a first reservoir 11 which may be made of any appropriate material, like for example glass, a plastic material, metal, etc. The first reservoir 11 comprises an upper shoulder 12 from which projects a neck 13 defining an opening of reduced cross-section. A dispensing member 14, such as a pump or even a valve, is mounted in a fixed and sealed manner in the opening of the neck 13 by means of a fixing ring 141, which may for example be a ring to be screwed. It is also possible to use a crimping ring or a snap-fitting ring. The dispensing member 14 is provided with a dispensing head 15 which integrates both a dispensing orifice 151 and a pusher 152. Without moving away from the scope of the invention, it is also possible to consider that the dispenser orifice is fixed and disconnected from the pusher. In an absolutely conventional manner, the dispensing head 15 is mounted on the actuator rod of the dispensing member 14 and integrates an internal feed channel that connects a dispensing orifice 151, which may for example be formed by a nozzle, capable of creating a spray. By bearing axially on the pusher 152, the dispensing member 14 is actuated, which results in a dispensing of pressurised fluid-product through the actuator rod and the dispensing head so as finally to exit through the dispensing orifice 151.

The second fluid-product dispenser 2 is less conventional. It also integrates a fluid-product reservoir 21 forming a neck 23, in which a second dispensing member 24, such as a pump or a valve, is mounted by means of a fixing ring 241, which may for example be a ring to be screwed, crimped or snap-fitted. The second dispensing member 24 may be a pump with or without an air inlet. This dispenser member 24 is equipped with a dispensing head 25 forming a dispensing orifice 251. A pusher 26 is mounted on the dispensing head 25 so as to actuate the dispensing member 24 and discharge fluid through the head 25 and finally through its spray orifice 251. The second dispenser 2 also comprises an outer shell 27 which is largely open at its lower end and also has a notch or opening 272 at its upper end for the passage of a portion of the pusher 26. The shell thus forms a window 271 for the dispensing orifice 241. The dispenser 2 also comprises an insert part 28 that is engaged inside the outer shell 27 and held in place by any appropriate means. The insert part 28 forms, with the outer shell 27, an inner space 281 in which the second reservoir 21 is disposed, as well as a receiving housing 282 in which the neck 13, the dispensing member 14, and its dispensing head 15 are received. The insert part 28 may also be used for the axial guidance of the pusher 26.

The second dispenser 2 is held in a removable manner on the first dispenser 1, for example by engaging with the fixing ring 141. For example, the inner wall of the receiving housing 282 may come into frictional contact with the outer wall of the fixing ring 141. A slight snap-fitting is possible. Holding by screwing or magnetisation is also possible. In a variant or in addition, it can also be considered that the outer shell 27 and/or the insert part 28 come into snap-fitting friction engagement with the first reservoir 11, for example at the periphery of the shoulder 12. According to a characteristic of the invention, the insert part 28 is removably mounted inside the outer shell 27, such that the part of the insert 28 can be extracted from the shell 27. In practice, the receiving housing 282 can be used to grasp firmly the insert part 28 (passage of a finger), in order to disengage it from the outer shell 27. The insert part 28 may simply be held by friction inside the outer shell 27, or also by a slight snap-fitting. Thus, it is possible to have access to the second reservoir 21 with its dispensing member 24 mounted thereon. It is thus possible to replace it or to fill it, in the case where the fixing ring 241 is removable. After replacement or filling, the insert part 28 with its reservoir mounted therein will again be inserted inside the outer shell 27, so as to reconstitute the second dispenser 2.

In the case where the dispensing member 24 can be removed from the second reservoir 21, it is advantageous to also provide a fixing ring 141 which can be removed from the first reservoir 11. It is thus possible to fill the second reservoir 21 with the first reservoir 11. Indeed, it can easily be observed in FIG. 1 that the capacity of the first reservoir 11 is considerably greater than that of the second reservoir 21. By way of indication, the first reservoir 11 may have a capacity of about 50 ml to about 200 ml, while the second reservoir 21 may have a capacity of about 10 ml.

With reference to FIG. 2, it can be seen that the second dispenser 2 integrates with the shape of the first dispenser 1, and particularly with the shape of the first reservoir 11. At first glance, the second dispenser 2 may be likened to a simple protective cap which covers the top portion of the first dispenser 1. Only the notch 272 for the pusher 26 and the oblong window 271 for the dispensing orifice 241 make it possible to understand that this particular cap acts as a dispenser.

With reference being made to FIG. 4, a second embodiment is seen, which is a variant of the first. The first dispenser 1 can be substantially or completely identical to the dispenser of the first embodiment. Only the second dispenser 2' differs from that of the first embodiment. In particular, it can be seen that the internal space 281' which houses the second reservoir 21' communicates widely with the receiving housing 282' which houses the upper part of the first dispenser 1. Thus, it is possible to extract the second reservoir 21', with its dispensing member 24, from the insert piece 28' embedded inside the outer shell 28. The second reservoir 21' can thus be replaced or filled. To this end, the reservoir 21' may comprise a filling valve 29, through which fluid-product may be injected into the reservoir 21'. For example, it is possible to remove the dispensing head from the first dispenser 1 so as to disengage its actuator rod. The second reservoir 21' can then be returned to the first dispenser 1 by engaging the actuator rod of the first dispenser 1 in the inlet of the filling valve 29. The dispensing member 24 may be an airless pump, i.e. without air intake, such that a depression is formed in the second reservoir 21'. This depression can be used to facilitate the filling of the reservoir 21' through the valve 29.

The second dispenser 2' can be removably connected to the first dispenser 1 by snap-fitting, clamping or friction at the level of the reservoir 11, and more specifically at the level of the outer periphery of the shoulder 12.

FIG. 5 shows a third embodiment wherein the first dispenser 1' has a first reservoir 11" having a capacity that is much smaller than the reservoir 21" of the second dispenser 2". The two dispensers 1' and 1" are connected together in a removable manner by means of an adaptation part 28". This comprises an upper sleeve 283 engaged firmly around the lower part of the second reservoir 21", a lower skirt 284 which bears on the first reservoir 11" or to be clamped externally on the outer wall of the reservoir 11", as well as a sleeve 285 in removable friction or snap-fitting engagement with the fixing ring 141 of the dispensing member 14".

In this third embodiment, the second dispenser 2" may have a configuration that is absolutely conventional for a perfume dispenser. On the other hand, the first dispenser 1" has a particular design, in particular a flattened design. Visually, the user sees an absolutely conventional dispenser 2" which is provided with a baseplate or base integrating the first dispenser 1". At first glance, the user may not perceive that there is a dispenser inside the baseplate or base of the dispenser 2".

The respective dispensing members 14" and 24 may be removably mounted on their respective reservoirs 11" and 21", such that the first reservoir 11" may be filled with the fluid contained in the second reservoir 21".

FIGS. 6 and 7 show a fourth particularly original embodiment. Indeed, the second dispenser 2''' is here fitted and held inside the first reservoir 11''' of the first dispenser 1'''. For this, the first reservoir 11''' forms a through or blind niche 12''', which in this embodiment is circular in shape. However, other shapes are possible. The second dispenser 2''' also has a circular configuration which is embedded in a removable manner inside this niche 12'''. The dispenser 2''' may, for example, be formed by a reservoir provided with a dispensing head 21''', for example in the form of a nozzle, a pusher 22''', for example in the form of a deformable actuating wall, and an optional filling plug 23'''. Once embedded inside the niche 12''', the dispenser 2''' is no longer usable, given that its dispensing head 21''' is masked, and possibly closed, by an inner wall of the niche 12'''. It can be considered to produce a niche 12''' which is not a through-passage, so as to place the actuating wall 22''' inside the niche, such that it is no longer accessible once the second dispenser 2''' is in place in its niche 12'''.

A reservoir blank may also be pressed so as to form a common wall separating two opposite niches, which may or may not be symmetrical. This would make it possible for a dispenser 2''' to be inserted in each niche 12'''. The two niches could also communicate by removing, for example by water jet, the common wall. This technique can be used to make one single through niche.

FIGS. **8*a* and 8*b* show a variant embodiment of the first embodiment in FIGS. 1 to 3. The first dispenser 1 can be substantially or completely identical to the dispenser of the first embodiment. Only the second dispenser 2*ab* differs from that of the first embodiment. Indeed, the second dispenser 2*ab* comprises a bottom part 2*a* integrating the second reservoir 21 and a top part 2*b* integrating the second dispensing member 24. The second reservoir 21 comprises a threaded neck 23*a* and the second dispensing member 24 comprises a screw-on fixing ring 241*b* which is in engagement with the threaded neck 23*a* of the second reservoir 21, such that the bottom part 2*a* and the top part 2*b* can be separated by unscrewing, so as to have access to the second reservoir 21 in order to extract it from the bottom part 2*a*. More specifically, the bottom part 2*a* comprises a lower shell 27*a* in which is engaged a lower insert part 28*a* which forms, with the lower shell 27*a*, a space 281 for the second reservoir 21, as well as a receiving housing 282 for the neck 13 and the pump 14 of the first dispenser 1. The top part 2*b* comprises an upper shell 27*b* in which is engaged a lower insert part 28*b* which guides the pusher 26 and which engages with the fixing ring 241*b* to be screwed in order to rotate it, in order to allow unscrewing and screwing onto the threaded neck 23***a*. In this embodiment, the insert parts 28*a* and 28*b* may be non-removably mounted in their respective shells 27*a* and 27*b*.

FIG. 9 shows another embodiment for a second dispenser 2*c*, which is distinguished from the others by a second reservoir 21*c* provided with a filling opening 29*c* which is closed by a plug 289. Advantageously, this plug 289 is formed by an insert part 28*c*, which is removably mounted in the shell 27*c*.

In all the embodiments described, a fluid-product dispenser is removably mounted on another fluid-product dispenser so as to prevent the actuation thereof or the actuation of the other dispenser. A particular dispenser assembly is thus defined which is neither a dual dispenser, nor really a source/nomadic dispenser, but rather a "pull-out" dispenser in the embodiments in FIGS. 1 to 5 and 8*a*, 8*b* and 9, or also a "kangaroo" dispenser in the last embodiment in FIGS. 6 and 7.

The invention claimed is:

1. A fluid-product dispensing assembly comprising:

a first fluid-product dispenser comprising a first reservoir, a first dispensing member provided with a first dispensing head and a first pusher, and a second fluid-product dispenser comprising a second reservoir, a second dispensing member provided with a second dispensing head and a second pusher, the second dispenser being removably mounted on the first dispenser so as to prevent actuation of one of the two dispensers;

wherein a capacity of the second reservoir is smaller than a capacity of the first reservoir;

wherein the second dispenser comprises an outer shell largely open at a lower end of the outer shell, a notch for the passage of the second pusher, and a window for a dispensing orifice;

wherein the second dispenser comprises an insert part which is engaged inside the outer shell and which forms with the outer shell an inner space in which the second reservoir is disposed, and a receiving housing in which the dispensing member of the first dispenser is received;

wherein the second dispenser is integrated with a shape of the first dispenser, such that the second dispenser forms a protective cover which covers an upper part of the first dispenser, wherein the notch and the window configured to permit actuation of the second dispenser.

2. The dispensing assembly according to claim 1, wherein the second dispenser is held by friction or snap-fitting on the first dispenser by masking the first dispensing head and the first pusher.

3. The dispensing assembly according to claim 1, wherein the first dispensing member is mounted on the first reservoir by means of a fixing ring, the second fluid-product dispenser removably engaging with the fixing ring.

4. The dispensing assembly according to claim 1, wherein the second reservoir is removably mounted in the outer shell so as to be manually removable from the outer shell.

5. The dispensing assembly according to claim 4, wherein the insert part is removably mounted in the outer shell and configured to be extracted manually from the outer shell so as to be able to extract the second reservoir.

6. The dispensing assembly according to claim 4, wherein the second dispenser comprises a bottom portion integrating the second reservoir and a top portion integrating the second dispensing member, the second reservoir comprising a threaded neck and the second dispensing member comprising a screw-on fixing ring which is engaged with the threaded neck of the second reservoir, such that the bottom and top portions are separable by unscrewing, so as to have access to the second reservoir in order to extract the second reservoir from the bottom portion.

7. The dispensing assembly according to claim 1, wherein the receiving housing communicates directly with an internal space, allowing the second reservoir to be removed through the receiving housing of the insert part.

8. The dispensing assembly according to claim 1, wherein the second dispensing member is removably mounted on the second reservoir and the first dispensing member is removably mounted on the first reservoir, so as to fill the second reservoir with the first reservoir.

9. The dispensing assembly according to claim 1, wherein the second reservoir is provided with a filling valve.

10. The dispensing assembly according to claim 1, wherein the second reservoir is provided with an opening closed by a plug.

11. The dispensing assembly according to claim 1, wherein the second reservoir is provided with an opening closed by a plug formed by the insert part.

12. The dispensing assembly according to claim 1, wherein the first dispensing member is a pump.

13. The dispensing assembly according to claim 1, wherein the second dispensing member is a pump.

14. The dispensing assembly according to claim 1, wherein the first dispensing member is a pump and the second dispensing member is a pump.

15. The dispensing assembly according to claim 1, wherein the second dispenser is integrated with the shape of the first reservoir.

16. The dispensing assembly according to claim 4, wherein the insert part is removably mounted in the outer shell and configured to be extracted manually from the outer shell by grasping the insert part by the receiving housing so as to be able to extract the second reservoir.

* * * * *